US006863366B2

(12) United States Patent
Premnath et al.

(10) Patent No.: US 6,863,366 B2
(45) Date of Patent: Mar. 8, 2005

(54) SINGLE ROLLER CLEANING SYSTEMS FOR FLUID EJECTOR SYSTEM

(75) Inventors: Karai P. Premnath, Rochester, NY (US); Stephen D. Cipolla, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/606,562

(22) Filed: Jun. 26, 2003

(65) Prior Publication Data

US 2004/0263557 A1 Dec. 30, 2004

(51) Int. Cl.[7] ..... B41J 2/165
(52) U.S. Cl. ..... 347/22; 347/32; 347/33
(58) Field of Search ..... 347/22, 21, 28, 347/29, 32, 33, 36, 37

(56) References Cited

U.S. PATENT DOCUMENTS 5,148,746 A 9/1992 Fuller et al.
6,318,835 B2 11/2001 Nakahara
6,336,699 B1 1/2002 Sarkissian et al.
6,350,012 B1 2/2002 Sarkissian et al.
6,532,025 B1 3/2003 Hiramatsu
6,550,891 B1 * 4/2003 Berg ..... 347/33

* cited by examiner

*Primary Examiner*—Shih-Wen Hsieh
(74) *Attorney, Agent, or Firm*—David E. Henn

(57) ABSTRACT

A cleaning system for a fluid ejector arrangement employing a single roller for handling different fluids that should not be mixed. The single roller is divided into portions assigned to respective fluids. In embodiments, the single roller is used to clean a plurality of ejectors, in which case each section of the roller handles one ejector. In other embodiments, the single roller is used to clean a single ejector that ejects to a plurality of fluids, in which case each section of the roller handles one fluid. Still other embodiments can employ a plurality of ejectors and a plurality of fluids ejected from one or more of the ejectors, wherein each section of the roller is assigned to a particular fluid, whether the fluid be ejected from the same ejector or from a different ejector.

30 Claims, 3 Drawing Sheets

SINGLE ROLLER CLEANING SYSTEMS FOR FLUID EJECTOR SYSTEM

FIELD OF THE INVENTION

Embodiments relate to fluid ejector cleaning. In particular, embodiments relate to inkjet printer printhead cleaning.

BACKGROUND AND SUMMARY

Typical cleaning systems for ink jet printers include separate cleaning elements for each color of ink employed by the printer. The motivation to provide such duplicate cleaning elements is to prevent cross-contamination of ink colors. However, the use of multiple, substantially identical cleaning elements increases the cost and complexity of ink jet printers unnecessarily. Additionally, prior attempts at using a single cleaning element have resulted in cross contamination. This principle can be applied on broader basis to other types of ejection systems. Multiple ejectors ejecting fluids that should not be mixed can be cleaned using embodiments, as can a single ejector ejecting multiple fluids that should not be mixed. Embodiments employed in inkjet printers will be discussed for ease of description, but other types of ejectors can employ embodiments as well.

Some ink jet printer printheads that use water based inks, such as, for example, acoustic and thermal ink jet printheads, are difficult to clean. Ink jet printers that use such difficult-to-clean printheads employ cleaning systems that become soiled over time. These soiled cleaning systems typically must be replaced at regular intervals. Ink jet printers that use such difficult-to-clean printheads also typically use complex seal mechanisms at the printhead-cleaning system interface to prevent cleaning fluid from spilling or otherwise leaking at the interface.

Some cleaning systems use rotating cleaning rollers that dip into cleaning fluid contained in a cleaning chamber. In operation, a squeegee roller bears against the cleaning roller and squeezes out excess cleaning fluid. Then, a rotating cleaning roller bears against the printhead to apply cleaning fluid to the soiled printhead. The applied cleaning fluid dissolves and washes away dried ink, including dried ink plugs, paper dust and other printhead contaminants from the printhead orifices into the cleaning fluid in the cleaning chamber, where the dried ink and other contaminants are dissolved into the cleaning fluid contained in the cleaning chamber.

Problems with ink jet printhead cleaning systems include buildup of ink and/or other contaminants in the cleaning fluid with each cleaning cycle, and evaporation of water and other non-volatile liquids from the cleaning solutions during periods of non-use. These problems sharply reduce the useful life of cleaning fluids by increasing the concentration levels of ink in the cleaning fluid.

That is, the concentration ratio of ink to cleaning fluid in the cleaning fluid contained in the cleaning chamber increases as the cleaning fluid is used to clean the printhead. As a result, the cleaning fluid becomes less efficient at cleaning the printheads. After a certain number of cleaning cycles, the cleaning fluid resident in the cleaning chamber becomes too contaminated to effectively clean printheads.

Embodiments provide methods and systems that maintain the concentration of ink in the cleaning fluid throughout the life of the printer at levels where the effectiveness of the cleaning fluid in removing contaminants is not substantially impaired.

Embodiments separately provide systems and methods that compensate for and/or reduce the evaporation of volatile chemical compounds from the cleaning fluid.

Embodiments separately provide systems and methods that reduce the build-up of ink and/or other contaminants in the cleaning fluid.

In various exemplary embodiments, one or more of these features can be provided by, for example, pumping cleaning fluid into the printhead cleaning chamber only when one or more of the printheads need to be cleaned. After the printhead cleaning operation is completed, the cleaning fluid left in the cleaning chamber is removed from the cleaning chamber and sent to holding tanks. The holding tanks are closed containers in which the cleaning fluids are held to prevent evaporation of volatile materials in the cleaning fluid.

At various intervals, a known amount of contaminated cleaning fluid is removed from one or more of the holding tanks to a leach bed. The leach bed has a capacity to hold waste cleaning fluid bled to it from the holding tanks and is able to evaporate the waste cleaning fluid effectively over the life of the printer. A measured amount of fresh, i.e. uncontaminated, substitute cleaning fluid is then added into the one or more holding tanks from a corresponding cleaning fluid container. This results in maintaining the ink/cleaning fluid concentration in the holding tanks within ranges that result in effective long term cleaning of the printheads, for example, for the useful life of the printer. This can also compensate for any volatile compounds lost from the usable cleaning fluid due to evaporation.

In particular, embodiments employ a single cleaning roller to clean all printheads in an inkjet printer. This is achieved by allocating portions of the cleaning roller to each printhead. Similarly, embodiments can employ a single cleaning roller to clean ejectors that eject fluids that should not be mixed, even in the case where one ejector ejects multiple fluids that should not be mixed.

Embodiments employ a timing system that synchronizes the cleaning roller with the position of the printhead. The timing system ensures that the specific sections of the cleaning roller are properly aligned to selectively clean, for example, the C, M, Y and K printheads of an inkjet printer. This substantially reduces color mixing and cross-contamination of colors.

The main thrust of the invention is a scheme, whereby it is possible to use one "common" cleaning roller for the C, M, Y and K printheads. This is achieved by apportioning sections of the cleaning roller for a particular color printhead. This is done by synchronizing the rotary motion of the cleaning roll and the translatory motion of the printheads across the cleaning roll so that the same section of the cleaning roll is always in contact with a particular color printhead during the cleaning cycle. The action of the cleaning roll during the cleaning cycle is two-fold: dissolve the dried ink on the apertures as well as any debris/detritus during one half of the cleaning cycle and during the second half to transfer waste ink and other debris from the printhead to the cleaning solution in the cleaning chamber.

Synchronization of the cleaning roller rotary motion and the translatory motion of the printhead slide is accomplished by establishing a zero "start point" through the rotary encoder on the cleaning roller motor for the cleaning roller and a zero "start point" for the printhead slide through the linear encoder on the printhead slide.

A cheaper alternative might be a light interrupt sensor that senses a flag attached to a drive gear on the cleaner roll assembly.

While it is true that the cleaner roll transport waste inks of all colors into one common cleaning sump, the amount of waste ink per printhead is small on the order of 0.05 to 0.1 ml max per printhead per color in a cleaning sump fill with cleaning fluid (typically de-ionized water) with a capacity of 200–300 ml.

The concentration ratio of the ink/cleaning fluid is important. For effective cleaning, an ink/cleaning fluid ratio of no greater than 0.15 has been established. That means that if we take the 200 ml capacity conservative case, for instance, as much as 30 mls of waste ink of all colors can be dumped into the cleaning tank before the cleaning solution has to be replaced in toto. In other words, 150 to 300 cleaning cycles can be accomplished without having to change the cleaning solution.

DETAILED DESCRIPTION

Figure 1:
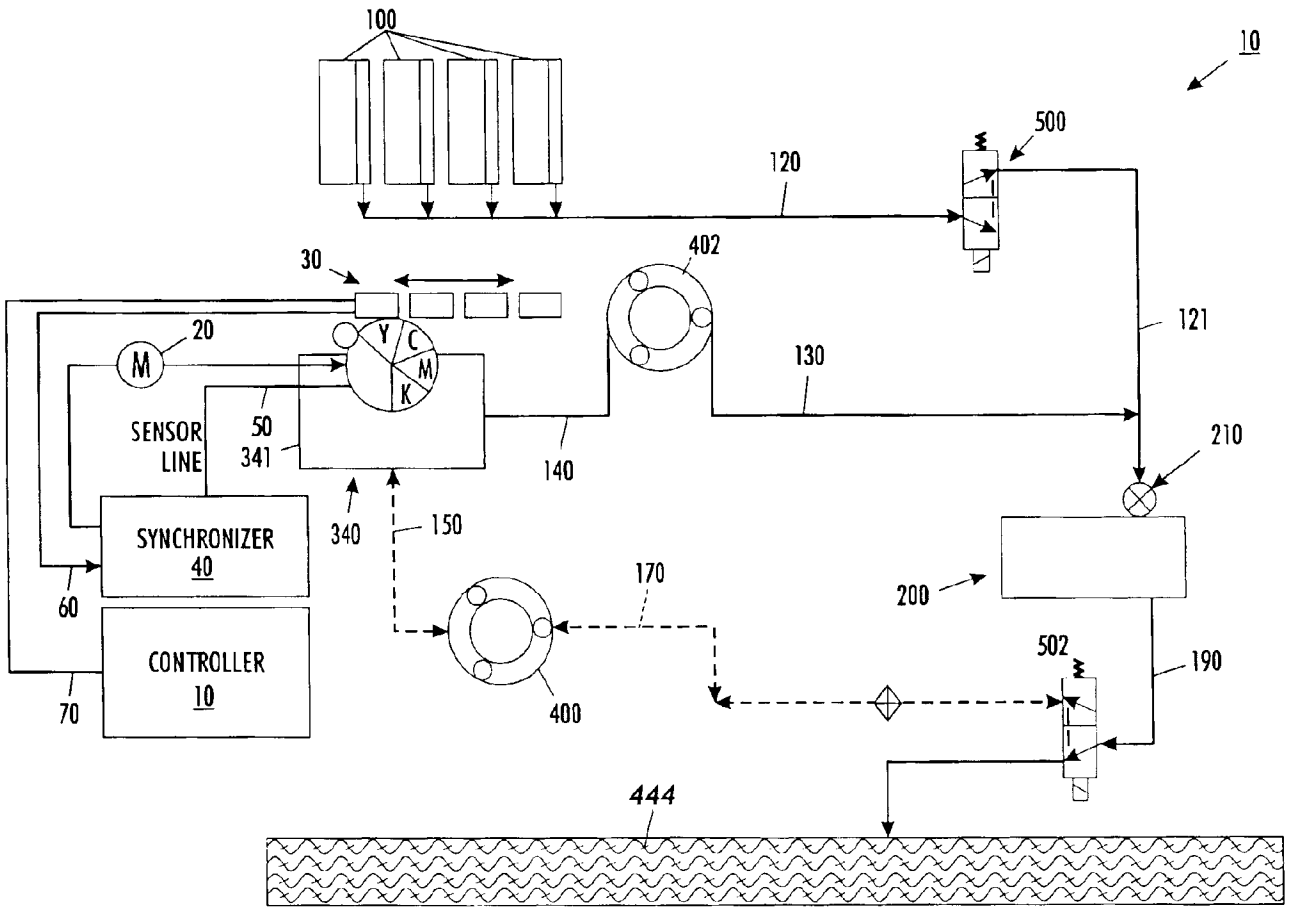
FIG. 1 is a schematic representation of a cleaning system according to embodiments of this invention.

As seen, for example, in FIG. 1, embodiments use a single cleaning roller 310 to handle cleaning of multiple fluids that should not be mixed from one or more ejectors 30, such as a printhead. Either a single ejector of fluid, such as a printhead of an ink-jet printer, can eject more than one fluid that should not be mixed, or multiple ejectors can eject such fluids. The single cleaning roller 310 has sections allocated for each fluid and is controlled in conjunction with a timing system 40 that ensures that the proper section of the cleaning roller treated 310, is aligned with a respective ejector 30, of fluid that requires cleaning. In a color inkjet printer, for example, a single cleaning roller 310 can be used for C, M, Y and K printheads 30, with timing means 40 synchronized with the position of the printhead that assigns specific sections of said cleaning roller to selectively clean the C, M, Y and K printheads to prevent color mixing and cross-contamination of colors. note that while embodiments will be described in the context of an inkjet printer, any fluid could conceivably be cleaned from a fluid ejector using embodiments.

FIG. 1 shows an exemplary embodiment of a cleaning system 10 for an ink jet printer in which embodiments can be employed. See, for example, U.S. Pat. No. 6,454,386, which is incorporated by reference. The ink cleaning system 10 includes a number of ink/cleaning fluid containers 100 that contain both ink to be provided to one or more printheads 30 and fresh, uncontaminated cleaning fluid. Each of the ink/cleaning fluid containers 100 has two chambers, one which holds ink and another which holds cleaning fluid. The ink jet printer is designed so that ink and/or cleaning fluid can be withdrawn from these dual-chambered containers 100.

The dual-chambered containers 100 are fluidly connected by a conduit 120 and valve 500 via a number of conduits 121 to a holding tank 200. A valve 210 is located in each of the conduits 121. The holding tank 200 is connected to a bleed line 190 which is connected to a bleed valve 502. The bleed valve 502 is connected to the leach pad 444 via the bleed line 276. The leach pad 444 is an evaporative waste pad made of an absorbent material such as, for example, felt.

The cleaning system 10 includes a cleaning chamber 340. In the prior art, cleaning chamber 340 typically has four separate compartments, each compartment being associated with one of the four printheads 30. However, in embodiments of the instant invention, there is a single chamber 340 to service all printheads 30 and/or ink and cleaning fluid containers 100 provided in a particular device. The cleaning chamber 340 contains a cleaning roller 310 and a squeegee roller 320 and is connected to a pinch valve 330. The pinch valve 330 is connected through a conduit 150 to a pump 400, which can be, for example, a peristaltic pump. The pump 400 is connected through a conduit 170 and the valves 210 to the holding tank 200. The cleaning chamber compartment 341 is connected through a conduit 140 to a second pump 402, which may, for example, be a peristaltic pump. The second pump 402 is connected through a conduit 130 and one of the conduits 121 and a valve 210 to the holding tank 200.

Instead of four separate cleaning compartments in the cleaning chamber 340, embodiments provided respect of sections of the cleaning roller 310 for each ejector/printhead 30. In inkjet printer employing black and three colors, for example, one section of the roller is assigned to each of black and the three colors. In the exemplary embodiment shown in FIG. 1, if multiple chambers were used, the peristaltic pump 400 would be used for the three chromatic colors, while the other peristaltic pump 402 would be used for the achromatic color (black). However, a pump may be provided, for example, for each individual color, or one pump could be provided to handle all cleaning compartments as seen in the Fig. Moreover, if there were no need for separate cleaning fluids for separate inks, only one holding tank need be provided, as is seen FIG. 1.

When the printheads 300 need to be cleaned, the peristaltic pumps 400 and 402 are run in a first direction to pump the cleaning fluid from the holding tank 200 to the cleaning chamber compartments 341. The holding tank vents are open during this operation. The cleaning roller 310, especially the section(s) of the roller that will be used to clean the particular printhead(s) 300 and/or the particular fluid(s), pick up the cleaning fluid. The squeegee roller 320 removes excess cleaning fluid and the squeegeed cleaning roller 310 then applies the cleaning fluid to the printhead(s) 300 to clean it/them.

The peristaltic pumps 400 and 402 then pump the used or contaminated cleaning fluid from the cleaning chamber compartment 341 to the holding tank 200. The holding tank vents are also open during this operation, then closed to prevent evaporation of volatiles from the cleaning fluid in the holding tank 200.

One advantage of this cleaning system 10 is that the cleaning system 10 can be made a permanent part of an ink jet printer. Because the cleaning system 10 is a permanent part of the ink jet printer and does not become significantly contaminated, there is no need to replace the cleaning system 10, or parts of the cleaning system 10, over the life of the ink jet printer. One advantage of the dual chamber containers 100 that contain an ink and a cleaning fluid, is that replacing any one or all of the dual chambered ink/cleaning fluid cartridges 100 provides a constant supply of fresh cleaning fluid.

The leach pad 444 is designed to absorb a significant amount of cleaning fluid without overflowing during the portion of the cleaning cycle in which cleaning fluid is bled from the tank 200 and to release the absorbed amount of cleaning fluid to atmosphere in between cleaning cycles so that by the time a cleaning cycle is resumed, including bleeding cleaning fluid from one or more holding tanks, the leach pad 444 will be able to absorb all of the fluid bled from the one or more holding tanks without overflowing and evaporate the fluid to atmosphere prior to the next cleaning cycle.

Figure 2:
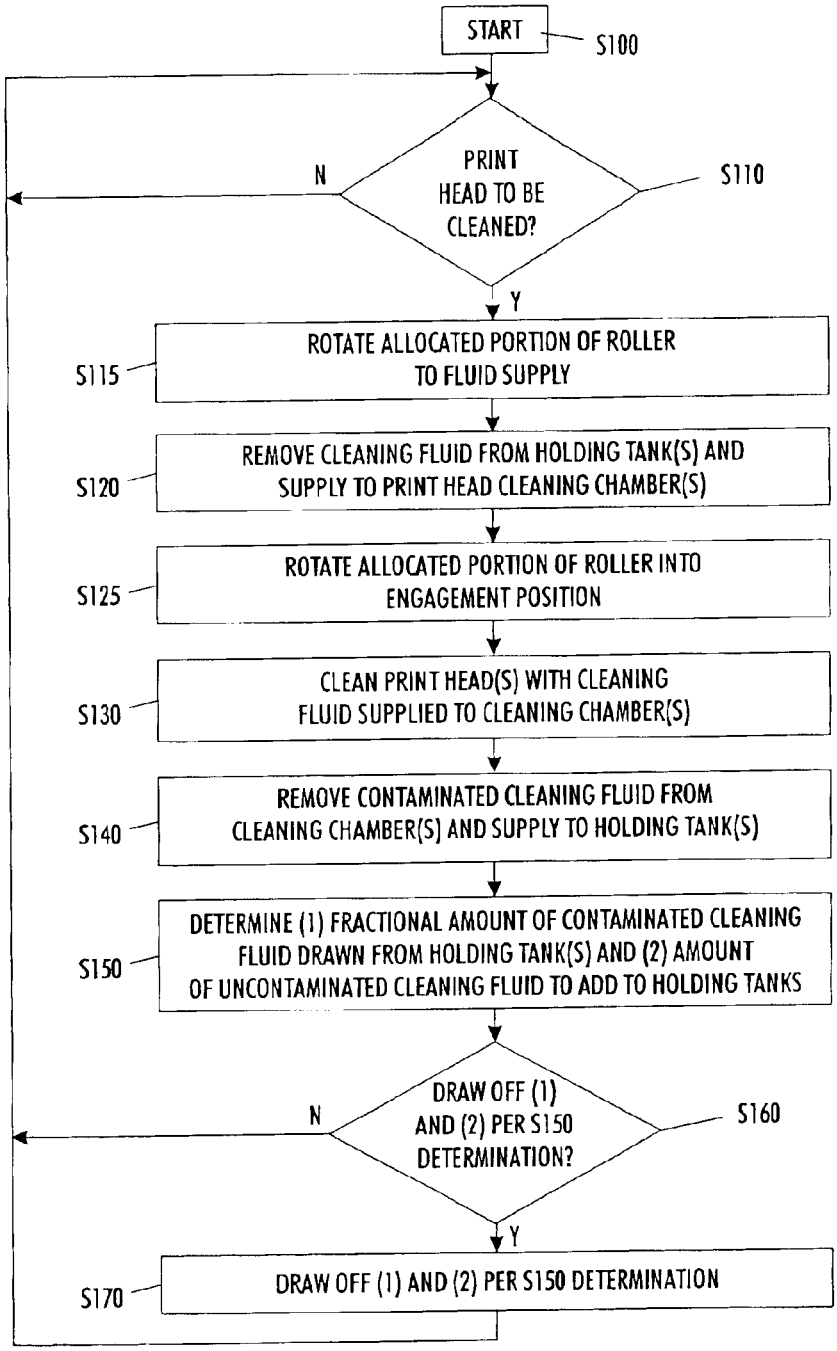
FIG. 2 is a schematic flow diagram illustrating a method of cleaning according to embodiments.

FIG. 2 is a schematic flow diagram outlining one exemplary embodiment of a method for cleaning printheads according to this invention. Beginning in block S100, control continues to block S110, where a determination is made of whether one or more printheads need cleaning. If at least one printhead needs cleaning, control continues to block S115, where the proper section of the cleaning roller is rotated into the cleaning fluid supply. Control then passes to block S120. Otherwise, if a determination is made that no printhead needs cleaning, control returns to block S110.

In block S120, cleaning fluid is moved from one or more holding tanks to a cleaning chamber. Next, in block S130, one or more of the printheads is cleaned using the cleaning fluid in the cleaning chamber. Then, in block S140, the used cleaning fluid is removed from the cleaning chamber and returned to one or more of the holding tanks. Control then continues to block S150.

In block S150, a fractional amount of used cleaning fluid to be drawn from the one or more holding tanks and forwarded to a leach pad is determined. Additionally, in block S150, an amount of fresh, uncontaminated cleaning fluid to be added to the used cleaning fluid in the one or more holding tanks to achieve a cleaning fluid with a contaminant-to-cleaning fluid concentration which will effectively clean the printheads is determined. Then, in block S160, a determination is made whether to draw off or bleed the determined amount of used, contaminated cleaning fluid from the one or more holding tanks, and to add the determined amount of fresh, uncontaminated cleaning fluid to those one or more holding tanks. This determination may be made based on the amount of contamination actually present or estimated to be present in the contaminated cleaning fluid, the capacity of the leach pad, the amount of uncontaminated cleaning fluid available, and/or the cost-effectiveness of reconstituting the cleaning fluid each cycle or every other cycle, or every third cycle, etc. If, in block S160, the fractional amount of contaminated fluid is to be drawn off, control continues to block S170. Otherwise, control jumps back to block S110. In block S170, the determined fractional amount of contaminated cleaning fluid is drawn from the holding tank to the leach pad and the determined amount of uncontaminated fluid is added to the holding tanks. Control then returns to block S110.

The determination of the amount of used, contaminated cleaning fluid to be bled from one or more holding tanks, and of the amount of fresh, uncontaminated cleaning fluid to be added to one or more holding tanks, may be accomplished in several ways. In one illustrative method, an empirical method is used. In order to determine how much contaminated cleaning fluid to remove and how much fresh cleaning fluid to add in this illustrative method, tests are run to determine how much ink can be in the cleaning solution and still have the cleaning solution effectively clean the printheads. If the cleaning solution is simply recycled without adding any additional cleaning solution, a point is reached where the ink contaminated cleaning solution can no longer effectively clean the printheads. Once that point is reached, a sample of the ink contaminated cleaning solution can be transferred from the cleaning container to the holding tank and then purged from the holding tank into a container. The optical density of the ink contaminated cleaning solution can be compared with the optical density of one or more cleaning solutions with various amounts of ink added to those cleaning solutions. When the optical density of the sample drawn from the printer matches that of the cleaning solution with a known amount of ink contamination, the amount of ink contamination which renders the cleaning solution ineffective is known. In this manner, or in similar manners, one can determine how much cleaning solution to add to the recycled cleaning solution to maintain a recycled cleaning solution with contaminants at an ink-to-cleaning solution ratio which will continue to effectively clean printheads. Adding cleaning solution to the recycled ink contaminated cleaning solution is accomplished in the holding tanks.

For example, in one exemplary embodiment of the systems and methods according to this invention, if it is determined that, on average, a printhead cleaning cycle results in addition of ink and other contaminants which constitute 5% by volume of the cleaning solution, and no degradation in printhead cleaning effectiveness occurs until those contaminants constitute 15% or more by volume of the cleaning solution, a fractional portion of the contaminated cleaning solution, for example, 5% by volume of contaminated cleaning fluid, may be removed from the holding tank, and a similar amount of fresh cleaning solution added every other cleaning cycle. Alternatively, for example, 2.5% by volume of contaminated cleaning fluid may be removed every cleaning cycle from the holding tank, and a corresponding amount of fresh cleaning solution added. In another exemplary embodiment, the optical density of the recycled cleaning fluid, e.g., in the holding tanks, can be monitored. When the monitored optical density reaches a certain value, which indicates that the contaminants are approaching 15% by volume of the recycled cleaning fluid, then a suitable fractional amount of the contaminated cleaning solution could be removed from the holding tanks or any other suitable location in the system and/or a suitable amount of fresh cleaning fluid added to reduce the contaminated cleaning solution to an optical density which was known to result in effective printhead cleaning. Care must be taken, however, so that the amount of fluid bled from the one or more holding tanks is within the capacity of the leach pad to absorb without overflowing, and which can be evaporated before more cleaning fluid is bled to the leach pad from the one or more holding tanks which could cause overflowing of the cleaning fluid from the leach pad.

If the amount of ink which is cleaned from the printhead and which enters the cleaning fluid is up to 15% by volume of the cleaning fluid, no observable reduction in the ability of the cleaning solution to adequately clean the printhead occurs. If the amount of ink which is cleaned from the printhead and which enters the cleaning fluid is between 15% and 30% of the volume of the cleaning fluid, only a slight reduction in the ability of the cleaning fluid to adequately clean the printhead occurs. However, if the amount of ink cleaned from the printhead and which enters the cleaning fluid is above 30% by volume, the ability of the cleaning solution to adequately clean the printhead begins to be significantly reduced.

As indicated above, the systems and methods according to this invention attempt to maintain a desired concentration of ink to cleaning fluid in the cleaning chamber to achieve effective printhead cleaning. After the printhead cleaning operation is completed, the cleaning fluid left in the cleaning chamber is removed from the cleaning chamber and sent to holding tanks, which are closed containers where the cleaning fluids are held to prevent evaporation of volatile materials in the cleaning fluid.

In various exemplary embodiments of the ink jet purging head cleaning systems and methods according to this invention, purging about 2.5% by volume of the used cleaning solution returned from the cleaning container to the holding tank and into the leach bed 444, and adding fresh cleaning solution in an amount of about 4% by volume of the amount of used cleaning solution returned from the cleaning container to the holding tank results in maintaining the contaminant to cleaning solution ratio of cleaning solution below 10% on a long term basis, such as, for example, over 2500 cleaning cycles. This is considered to maintain the ink/cleaning fluid concentration within a range which results in effective cleaning of printheads over the average life of an ink jet printer.

In a second illustrative embodiment, step S150 may involve the use of a real time sensor, which can be used to make an actual measurement of the degree of contamination of the cleaning solution.

Figure 3:
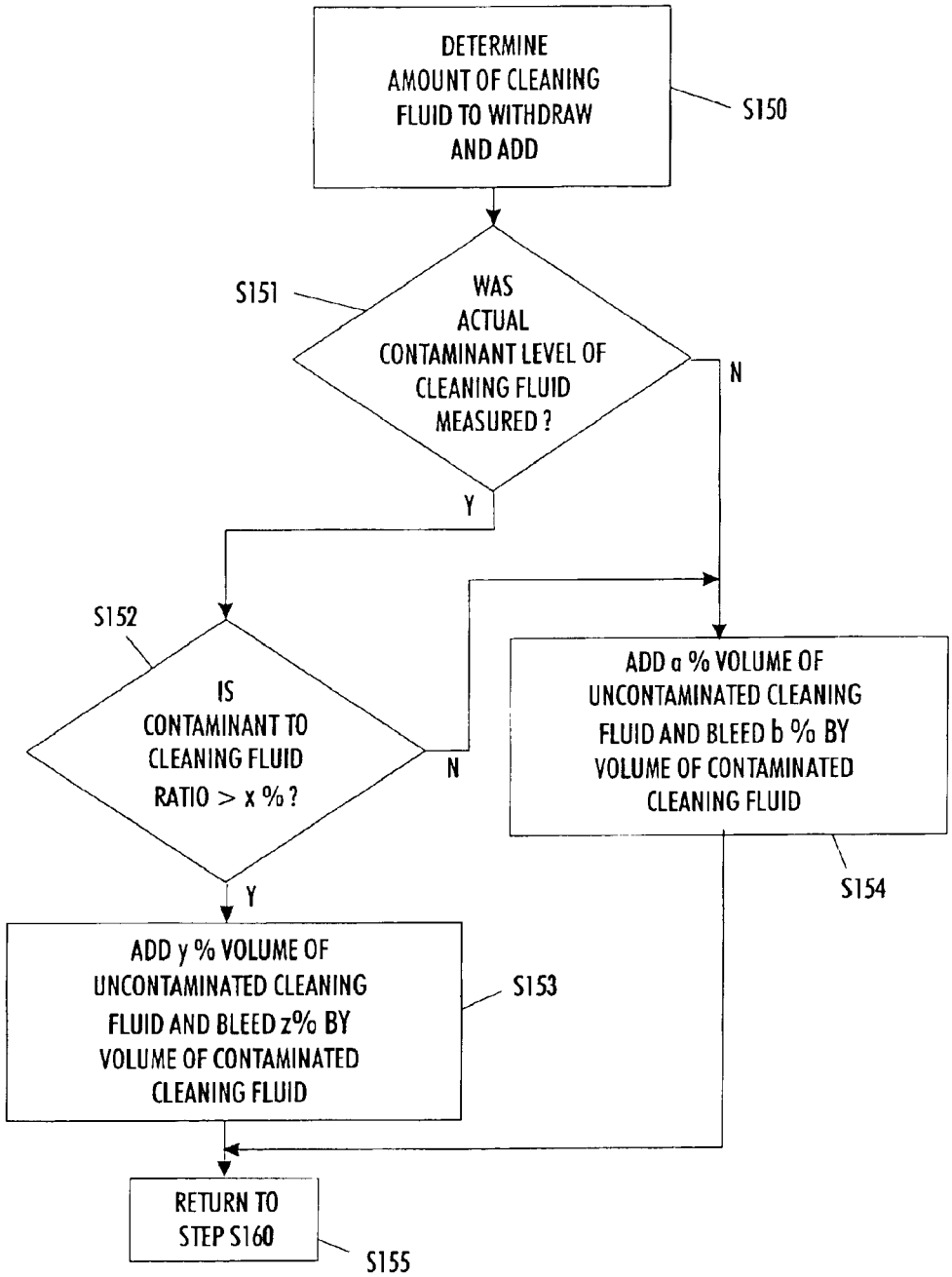
FIG. 3 is a schematic flow diagram of other aspects of embodiments.

FIG. 3 shows in greater detail one exemplary embodiment of a method for making the determinations of step S150. As indicated above, in step S150, a determination of (1) the fractional amount of contaminated cleaning fluid to be drawn from the holding tank(s) and (2) the amount of uncontaminated cleaning fluid to add to the holding tank(s) is made. Thus, beginning in step S150, control continues to step S151, where a determination is made whether an actual measurement was made of the contaminant level of the cleaning fluid. If such a measurement was not made, control jumps to step S154. Otherwise, control continues to step S152.

In step S152, a determination is made whether the contaminant to cleaning fluid ratio is above a certain level, such as, for example, above x % by volume, where x is an empirically determined value. If the contaminant level is not above x % by volume, then control jumps to step S154. Otherwise, control moves to step S153.

In step S153, a determination is made to add y % by volume, where y is an empirically determined value, of uncontaminated cleaning fluid to, and draw off z % by volume, where z is an empirically determined value, of contaminated cleaning fluid from, one or more of the holding tanks. Control then passes to step S155.

In contrast, in step S154, a determination is made based on empirical data to add a % by volume, where a is an empirically determined value, of uncontaminated cleaning fluid to, and to bleed b % by volume, where b is an empirically determined value, of contaminated fluid from, one or more of the holding tanks. As indicated above, in various exemplary embodiments, b % was empirically determined to be about 2.5% by volume and a % was empirically determined to be about 4% by volume. Control then continues to step S155, which returns control to step S160.

When making an actual determination of the contaminant concentration, a sensor (not shown) may be placed anywhere in the system from, and including, the cleaning chamber to the holding tanks. The sensor may be, for example, an optical absorption detector or an electrical impedance detector, or an acoustic detector. The output from the sensor is compared with values obtained from a look-up table, for example, to determine how much used cleaning fluid to be drawn off and how much fresh cleaning fluid to be added to the used cleaning fluid to maintain a contaminant to cleaning fluid concentration ratio which will result in effective cleaning of the printheads.

If an actual, real time, determination of the contaminant concentration of the used cleaning fluid is not used, an empirical approach may be used. In this illustrative embodiment, the amount of used cleaning fluid to be drawn off and the amount of fresh cleaning fluid to be added to keep the contaminant to cleaning fluid ratio in an acceptable range over the expected life of the printer to achieve effective printhead cleaning is determined on a trial-and-error basis, as outlined above. These amounts can remain unchanged throughout the life of the printer or may be adjusted by a user should printhead cleaning not be acceptable.

One example of a cleaning solution used with this invention is de-ionized water which contains a small amount of co-solvent, such as, for example, N-methyl-Pyrrolidinone and trace bio-cide, such as, for example, sodium omadine or DOWICIL®.

Because the cleaning chamber 340, which houses the cleaning rollers 310, is not discarded or changed over the life of the printer, and there is no cleaning fluid circulating when the cleaning system 10 is not in use, there is little danger of spilling cleaning solution. Consequently, there is no need for complex sealing mechanisms at the interface of the cleaning rollers 310 and the printheads 300.

The capacity of each holding tank is larger than the capacity of each cleaning chamber, so that regardless of the amount of fresh cleaning fluid added to the contaminated cleaning fluid, the holding tanks have sufficient capacity to add enough fresh cleaning fluid to maintain the concentration of ink to cleaning fluid at a level where the effectiveness of the cleaning fluid in removing contaminants from the printhead is not significantly impaired.

The size and composition of the leach bed 444 may vary depending on the capacity of cleaning fluid which is desired to be bled from the holding tanks at a given time, and on the ability of the leach bed to rapidly evaporate that fluid. In one exemplary embodiment, the leach bed is a container made of polypropylene of a rectangular shape with a capacity to hold at least 1000 ml of waste fluid at any given moment without dripping. The absorbent material is NOMEX® felt, but may be made of any suitable woven or non-woven material, natural or synthetic. The size of the absorbent pad is at least 1200 cc and is capable of absorbing and holding 1000 ml of water without overflowing.

The amount of contaminated cleaning fluid withdrawn from the cleaning system, which is bled out into the leach bed 444 for evaporation, and the amount of fresh cleaning fluid to be added to the cleaning system may be controlled by conventional microprocessor control based either on dynamic real time input from a device which measures a suitable cleaning fluid parameter, such as, for example, optical density, electrical impedance or acoustic absorption.

The main thrust of the invention is a scheme, whereby it is possible to use one "common" cleaning roller for the C, M, Y and K printheads. This is achieved by apportioning sections of the cleaning roller for a particular color printhead. This is done by synchronizing the rotary motion of the cleaning roll and the translatory motion of the printheads across the cleaning roll so that the same section of the cleaning roll is always in contact with a particular color printhead during the cleaning cycle. The action of the cleaning roll during the cleaning cycle is two-fold: dissolve the dried ink on the apertures as well as any debris/detritus during one half of the cleaning cycle and during the second half to transfer waste ink and other debris from the printhead to the cleaning solution in the cleaning chamber.

Synchronization of the cleaning roller rotary motion and the translatory motion of the printhead slide is accomplished by establishing a zero "start point" through the rotary encoder on the cleaning roller motor for the cleaning roller and a zero "start point" for the printhead slide through the linear encoder on the printhead slide.

A cheaper alternative might be a light interrupt sensor that senses a flag attached to a drive gear on the cleaner roll assembly.

While it is true that the cleaner roll transport waste inks of all colors into one common cleaning sump, the amount of waste ink per printhead is small on the order of 0.05 to 0.1 ml max per printhead per color in a cleaning sump fill with cleaning fluid (typically de-ionized water) with a capacity of 200–300 ml.

The concentration ratio of the ink/cleaning fluid is important. For effective cleaning, an ink/cleaning fluid ratio of no greater than 0.15 has been established. That means that if we take the 200 ml capacity conservative case, for instance, as much as 30 mls of waste ink of all colors can be dumped into the cleaning tank before the cleaning solution has to be replaced in toto. In other words, 150 to 300 cleaning cycles can be accomplished without having to change the cleaning solution.

It is appreciated that various other alternatives, modifications, variations, improvements, equivalents, or substantial equivalents of the teachings herein that, for example, are or may be presently unforeseen, unappreciated, or subsequently arrived at by applicants or others are also intended to be encompassed by the claims and amendments thereto.

What is claimed is:

1. A cleaning apparatus comprising:

a cleaning element;

a synchronizer that places a predetermined section of the cleaning element in alignment with a respective ejector; and an actuator that moves the cleaning element against the ejector with which the respective portion of the cleaning element has been aligned to clean the ejector.

2. The apparatus of claim 1 wherein the cleaning element services at least two ejectors and a respective portion of the cleaning element is dedicated to each of the at least two ejectors.

3. The apparatus of claim 2 wherein the at least two ejectors are printheads of an ink jet printer.

4. The apparatus of claim 3 wherein the at least two ejectors comprise at least four ejectors in a color ink jet printer.

5. The apparatus of claim 1 wherein the cleaning element services at least one ejector applying at least one fluid that possesses at least two properties and respective portions of the cleaning element are dedicated to each of the at least two properties.

6. The apparatus of claim 5 wherein the at least one fluid is ink and the at least two properties are colors so that a respective portion of the cleaning element is dedicated to each color of ink.

7. The apparatus of claim 6 wherein there are at least four colors.

8. In an inkjet printer including a plurality of printheads, a printhead cleaning apparatus comprising:

a cleaning element for the plurality of printheads;

a synchronizer that places a predetermined section of the cleaning element in alignment with a respective one of the plurality of printheads; and an actuator that moves the cleaning element against the plurality of printheads to clean the respective printhead with which the respective portion of the cleaning element has been aligned.

9. The apparatus of claim 8 wherein the cleaning element services at least four printheads and a respective portion of the cleaning element is dedicated to each of the at least four printheads.

10. The apparatus of claim 9 wherein the inkjet printer is a color inkjet printer and the at least four printheads are arranged in the color ink jet printer.

11. The apparatus of claim 8 wherein at least one printhead applies at least one fluid that possesses at least two properties and respective portions of the cleaning element are dedicated to each of the at least two properties.

12. The apparatus of claim 11 wherein the at least one fluid is ink and the at least two properties are colors so that a respective portion of the cleaning element is dedicated to each color of ink.

13. The apparatus of claim 12 wherein there are at least four colors.

14. The apparatus of claim 8 wherein the plurality of printheads ejects at least one fluid that possesses at least two properties and respective portions of the cleaning element are dedicated to each of the at least two properties.

15. The apparatus of claim 8 wherein the synchronizer comprises an actuator responsive to a rotary encoder associated with the cleaning element.

16. The apparatus claim 8 wherein the synchronizer comprises an actuator responsive to a light sensor associated with the printhead.

17. A method of cleaning a plurality of ejectors comprising:

providing a cleaning element;

allocating sections of the cleaning element for use with respective ejectors;

aligning an allocated section of the cleaning element with its respective ejector; and moving the cleaning element against the respective ejector with which the respective portion of the cleaning element has been aligned, thereby cleaning the ejector.

18. The apparatus of claim 17 wherein the plurality of ejectors are printheads of an ink jet printer.

19. The apparatus of claim 17 wherein the plurality of ejectors comprise at least four printheads in a color ink jet printer.

20. A method of cleaning at least one ejector comprising:

providing a cleaning element;

allocating sections of the cleaning element for use with respective ejected fluids that the at least one ejector ejects;

aligning an allocated section of the cleaning element with an ejector from which its respective ejected fluid has been ejected; and moving the cleaning element against the ejector with which the respective portion of the cleaning element has been aligned, thereby cleaning the ejector.

21. The method of claim 20 wherein the ejected fluids possess properties that, were the ejected fluids to be mixed, would produce undesirable results.

22. The method of claim 20 wherein the ejected fluids comprise ink and the properties comprise colors so that a respective portion of the cleaning element is dedicated to each color of ink.

23. The method of claim 22 wherein the properties comprise at least four colors.

24. The method of claim 20 further comprising establishing an initial position of the cleaning element, establishing an initial position of the printhead, and ensuring that a proper allocated section of the cleaning element be aligned with its respective printhead when printhead and cleaning element collide.

25. The method of claim 24 further comprising associating a rotary encoder with a cleaning roller motor.

26. The method of claim 24 further comprising associating a translation sensor with the printhead.

27. The method of claim 26 wherein the translation sensor is a linear encoder.

28. The method of claim 24 further comprising providing a light sensor associated with one of the cleaning element and the printhead.

29. The method of claim 28 further comprising providing a flag on a drive gear of the cleaner element, and providing a light sensor comprises arranging a light interrupt sensor responsive to the flag.

30. The method of claim 24 further comprising providing a cleaning sump into which the element travels and deposits material cleaned from the at least one ejector.

* * * * *